US012515142B1

(12) United States Patent
Wang

(10) Patent No.: US 12,515,142 B1
(45) Date of Patent: Jan. 6, 2026

(54) TRANSMISSION ASSEMBLY FOR BOUNCING TOYS

(71) Applicant: Liying Wang, Shantou (CN)

(72) Inventor: Liying Wang, Shantou (CN)

( * ) Notice: Subject to any disclaimer, the term of this patent is extended or adjusted under 35 U.S.C. 154(b) by 0 days.

(21) Appl. No.: 18/895,246

(22) Filed: Sep. 24, 2024

(51) Int. Cl.
*A63H 31/08* (2006.01)
*A63H 29/22* (2006.01)

(52) U.S. Cl.
CPC ..... *A63H 31/08* (2013.01); *A63H 29/22* (2013.01)

(58) Field of Classification Search
CPC ..... A63H 29/00; A63H 29/22; A63H 31/00; A63H 31/08; A63H 33/002; A63H 33/26
See application file for complete search history.

(56) References Cited

U.S. PATENT DOCUMENTS 2,749,893 A * 6/1956 Porsche ..... F02B 75/243 123/90.31
3,101,077 A * 8/1963 Engle ..... F01L 1/14 74/568 FS
3,795,229 A * 3/1974 Weber ..... F01L 1/14 74/569
4,335,318 A * 6/1982 Mabuchi ..... F02N 11/04 446/457
6,412,362 B1 * 7/2002 Leung ..... A63H 33/042 74/413
7,204,455 B2 * 4/2007 Sinclair ..... B64U 50/19 244/72
8,827,030 B1 * 9/2014 Strenge ..... A63H 31/00 180/374
9,586,156 B2 * 3/2017 Russo ..... A63H 11/10
11,266,920 B2 * 3/2022 Jensen ..... F16D 11/14
11,944,918 B1 * 4/2024 Cai ..... A63H 29/22
2009/0023359 A1 1/2009 Lu

* cited by examiner

*Primary Examiner* — John A Ricci
(74) *Attorney, Agent, or Firm* — Che-Yang Chen; Law Office of Michael Chen

(57) ABSTRACT

A transmission assembly for bouncing toys includes a transmission shaft and a push rod, wherein the transmission shaft is composed of a first transmission shaft, a transmission gear, and a second transmission shaft. The transmission shaft body is provided with a plurality of protruding rods, and the inclination angles of each protruding rod are inconsistent. The push rod body is provided with a node, and the transmission shaft is provided above the push rod. When the rotating shaft rotates, the protruding rod of the transmission shaft pushes the node of the push rod forward. The bouncing device can be triggered by pressing the button downward to push the disk above the push rod, or the transmission gear is driven by the power supply to drive the transmission shaft to rotate.

4 Claims, 8 Drawing Sheets

TRANSMISSION ASSEMBLY FOR BOUNCING TOYS

FIELD OF THE INVENTION

The present invention relates to the technical field of game toys, and in particular relates to a transmission assembly for bouncing toys.

BACKGROUND OF THE INVENTION

Bouncing toy are a type of popular toy on the market. Generally, the turntable is driven by a motor, bouncing objects will be launched during the rotation of the turntable, and children catch the bouncing objects with their hands or a net, which can improve their reaction ability. Bouncing toys generally consist of a bouncing device and a trigger device, the trigger device is driven by power source and then trigger the bouncing device. However, there are some shortcomings in the bouncing toys of prior arts: firstly, the traditional bouncing toy is driven by motor, which is inconvenient to use; secondly, the traditional bouncing toy has a complex structure, and the bouncing device and the trigger device are easily get stuck during use and cannot be reset, which reduces the service life of the toy; finally, the traditional bouncing toy is triggered by the rotation of the turntable in sequence, which lacks fun in playing.

SUMMARY OF THE DISCLOSURE

In order to solve the above shortcomings, the present invention provides a transmission assembly for bouncing toys, which is easy to use with simple structure, can be driven manually or by power, and has the function of resetting, thereby extending the service life of bouncing toys and making it interesting.

In order to achieve the above objects, the present invention provides the following technical solutions:

A transmission assembly for bouncing toys, including a transmission shaft and a push rod, the transmission shaft is composed of a first transmission shaft, a transmission gear, and a second transmission shaft. The transmission shaft body is provided with a plurality of protruding rods, and the inclination angles of each protruding rod are inconsistent. The push rod body is provided with a node, the transmission shaft is provided above the push rod, and when the rotating shaft rotates, the protruding rod of the transmission shaft pushes the node of the push rod forward.

The first transmission shaft is provided with a reset rod, and the reset rod is provided with a handle. During the rotation of the transmission shaft, the bouncing device of the traditional bouncing toys is easily to get stuck, but the push rod can be pushed by rotating the reset rod in the present invention.

The push rod is divided into the long push rod and the short push rod, the long push rod and the short push rod are arranged alternately. Two elliptical holes are arranged on the push rod, and a hook is arranged on the push rod.

A trigger is provided at the tail of the push rod, and the end of the trigger is a disc.

The head of the push rod is trapezoidal, a button is provided on the push rod, a spring is connected to the middle of the button, and the button returns to its initial position under the elastic force of the spring after being pressed.

A motor is provided below the transmission assembly, and the motor is provided with a pinion. The power source drives the pinion of the motor, so as to drive the transmission gear of the transmission shaft.

The beneficial effects of the present invention are:

A transmission assembly of bouncing toys in the present invention, the bouncing device can be triggered by pressing the button downward and then pushing the disc above the push rod, or the transmission gear is driven by the power supply to drive the transmission shaft to rotate, and the protruding rod of the transmission shaft pushes the node of the push rod forward, in order to push the disc above the push rod to trigger the bouncing device. At the same time, when the disc and the bouncing device are stuck, the disc can be moved by rotating the reset rod. In addition, due to the inconsistent angles of the protruding rods of the transmission shaft, the movement of the push rod is relatively random, and the triggering of the bouncing device is also relatively random, which increases the fun of the toy.

DETAILED DESCRIPTION OF THE PREFERRED EMBODIMENTS

Figure 1:
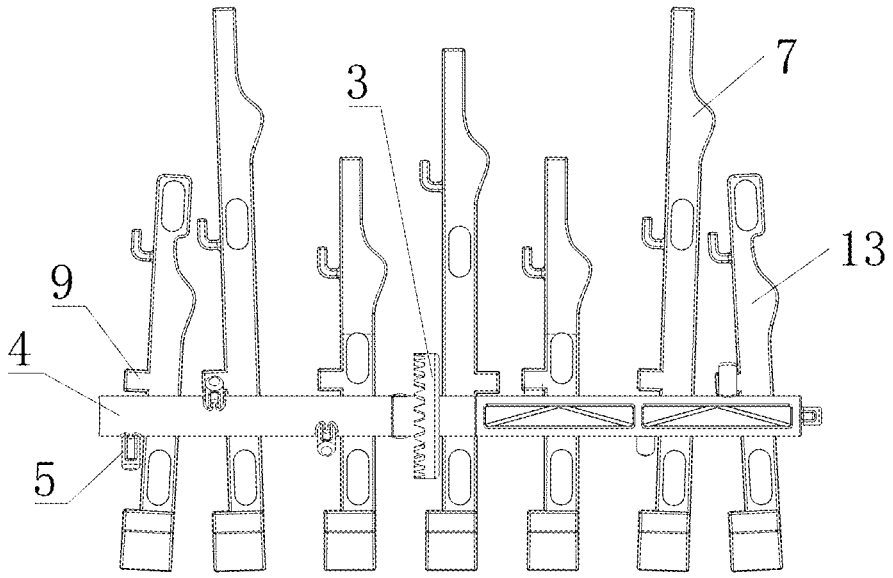
FIG. 1 is a structural view of the transmission assembly.
Figure 2:
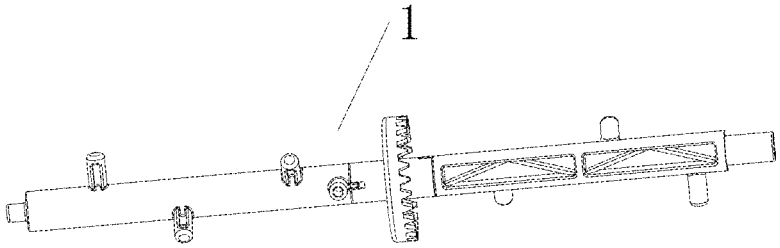
FIG. 2 is a structural view of the transmission shaft.
Figure 3:
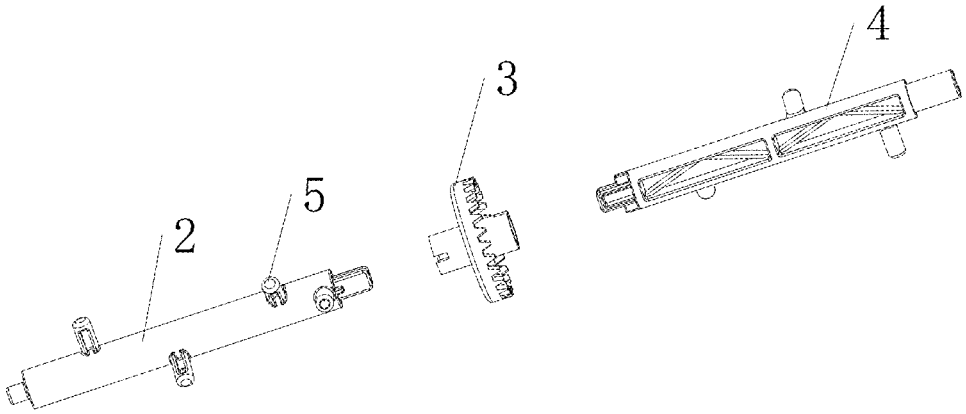
FIG. 3 is a disassembled structural view of the transmission shaft.
Figure 4:
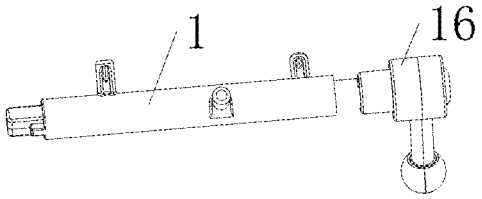
FIG. 4 is a schematic view showing the connection between the transmission shaft and the reset rod.

As shown in FIGS. 1-7, a transmission assembly for bouncing toys includes a transmission shaft 1 and a push rod 6, the transmission shaft 1 is composed of a first transmission shaft 2, a transmission gear 3, and a second transmission shaft 4. The transmission shaft 1 body is provided with a plurality of protruding rods 5, and the inclination angles of each protruding rod 5 are inconsistent. The push rod 6 is provided with a node 9, the transmission shaft 1 is placed above the push rod 6, when the rotating shaft 1 rotates, the protruding rod 5 of the transmission shaft 1 pushes the node 9 of the push rod 6 forward. The first transmission shaft 2 is provided with a reset rod 16, and the reset rod 16 is provided with a handle, the entire transmission shaft 1 can be driven by shaking the handle. The push rod 6 is divided into the long push rod and the short push rod, the long push rod and the short push rod are arranged alternately. Generally, the length of the short push rod is between ½ and ⅔ of the long push rod. The push rod 6 is provided with an first elliptical hole 11 and a second elliptical hole 12, and a hook 10 is provided on the push rod 6. The tail 8 of the push rod 6 is provided with a trigger 13, and the end of the trigger 13 is provided with a disc 14.

Figure 5:
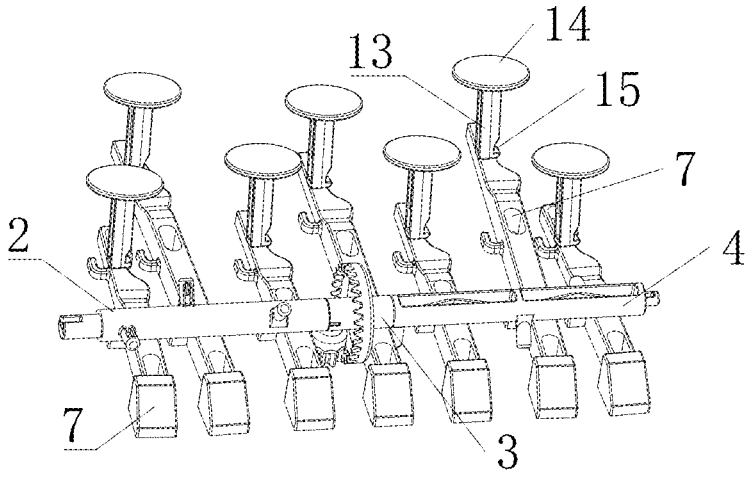
FIG. 5 is a schematic view showing the connection between the transmission assembly and the trigger.
Figure 6:
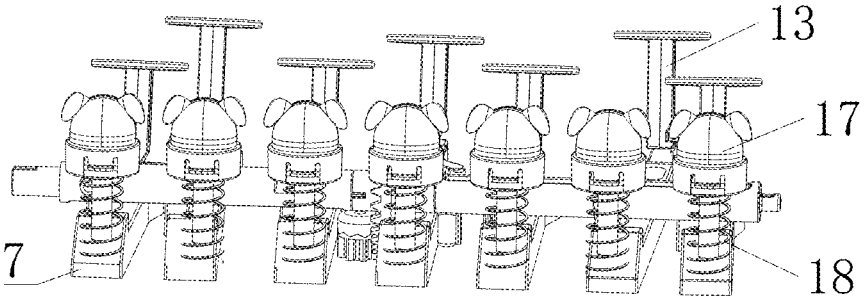
FIG. 6 is a schematic view showing the connection between the button and the transmission assembly.

As shown in FIGS. 5-6, the head 7 of the push rod 6 is trapezoidal, a button 17 is provided on the push rod 6, and a spring 18 is connected to the middle of the button 17. The button 17 returns to its initial position under the elastic force of the spring 18 after being pressed. When the button 17 is pressed manually, the button 17 pushes the push rod 6 forward, the trigger 13 is connected to the tail 8 of the push rod 6, and the disc 14 of the trigger 13 pushes the triggers the bouncing device.

Figure 7:
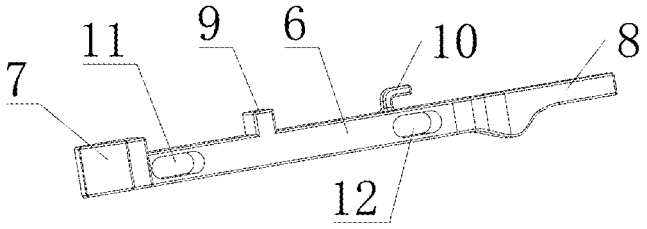
FIG. 7 is a structural view of the push rod.
Figure 8:
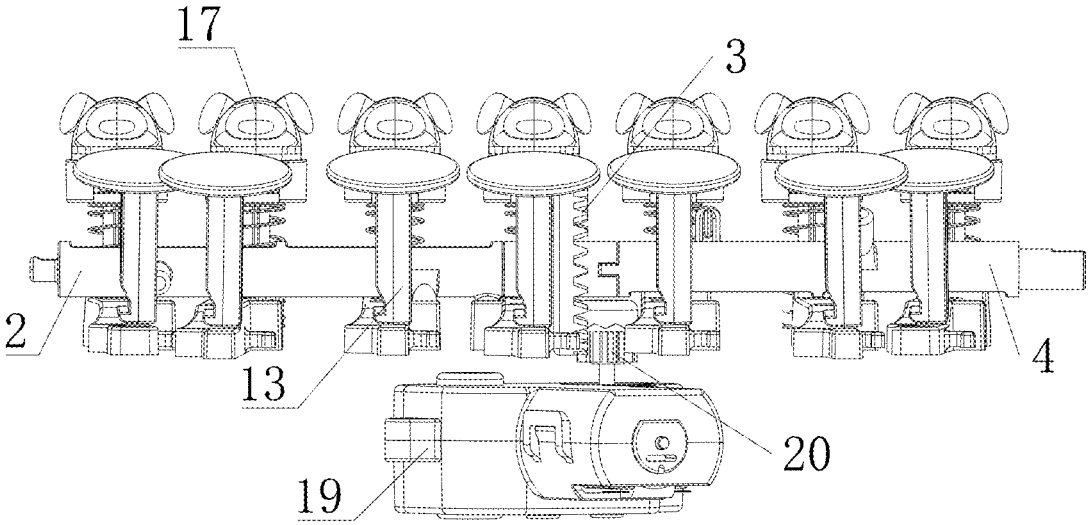
FIG. 8 is schematic view showing the connection between the motor and the transmission assembly.

As shown in FIG. 7, the transmission assembly can be driven by a motor 19, which is connected to a pinion 20. The power source drives the pinion 20 of the motor 19 to rotate, and the pinion 20 drives the transmission gear 3 to rotate, and the transmission gear 3 drives the entire transmission shaft 1 to rotate. The protruding rod 5 of the rotating shaft 1 pushes the node 9 and pushes the entire push rod 6 forward, the trigger 13 is connected to the tail 8 of the push rod, and the disc 14 of the trigger 13 pushes the triggers the bouncing device.

The bouncing device generally has a clamping structure, a spring, and a corresponding release structure that can release the clamping structure. The release structure is pushed by the disc 14 to unlock the clamping structure and trigger the bouncing device.

What is claimed is:

1. A transmission assembly for bouncing toys, comprising a transmission shaft and a push rod, wherein the transmission shaft is composed of a first transmission shaft, a transmission gear and a second transmission shaft; wherein a transmission shaft body is provided with a plurality of protruding rods, and an inclination angle of each protruding rod is inconsistent; a push rod body is provided with a node, the transmission shaft is provided above the push rod, and when a rotating shaft rotates, each of the protruding rods of the transmission shaft pushes the node of the push rod forward, wherein the first transmission shaft is provided with a reset rod, and the reset rod is provided with a handle; and the push rod is divided into a long push rod and a short push rod, the long push rod and the short push rod are arranged alternately; two elliptical holes are provided on the push rod, and a hook is provided on the push rod.

2. A transmission assembly for bouncing toys according to claim 1, wherein a trigger is provided at a tail of the push rod, and an end of the trigger is a disc.

3. A transmission assembly for bouncing toys according to claim 1, wherein a head of the push rod is trapezoidal, a button is provided on the push rod, a spring is connected to a middle of the button, and the button returns to an initial position thereof under the elastic force of the spring after being pressed, and a trigger is provided at a tail of the push rod, and an end of the trigger is a disc.

4. A transmission assembly for bouncing toys according to claim 1, wherein a motor is provided below the transmission assembly, and the motor is provided with a pinion.

* * * * *